US007273358B2

(12) United States Patent
Wang

(10) Patent No.: US 7,273,358 B2
(45) Date of Patent: Sep. 25, 2007

(54) AIR PUMP

(76) Inventor: Wei-Chi Wang, 17-1 Fl., No. 457, Cheng-Kung Rd., Tainan (TW)

( * ) Notice: Subject to any disclaimer, the term of this patent is extended or adjusted under 35 U.S.C. 154(b) by 315 days.

(21) Appl. No.: 11/008,873

(22) Filed: Dec. 9, 2004

(65) Prior Publication Data

US 2006/0127248 A1 Jun. 15, 2006

(51) Int. Cl.
*F04B 17/00* (2006.01)
*F04B 35/04* (2006.01)
*F04B 35/00* (2006.01)

(52) U.S. Cl. ..... 417/415; 417/360; 417/410.1

(58) Field of Classification Search ..... 417/415, 417/360, 410.1
See application file for complete search history.

(56) References Cited

U.S. PATENT DOCUMENTS 6,551,077 B2 * 4/2003 Chou ..... 417/415
6,716,003 B2 * 4/2004 Chen ..... 417/415

* cited by examiner

*Primary Examiner*—Anthony D. Stashick
*Assistant Examiner*—Patrick Hamo
(74) *Attorney, Agent, or Firm*—patenttm.us; James H. Walters

(57) ABSTRACT

An air pump includes a body being composed of two semi-housings. A sleeve is received in an opening at a top of the body. A rim is formed at a top of the sleeve and an annular recess is defined at a bottom of the sleeve. By fasteners through the rim, the sleeve is secured in the body. A motor is mounted on the body for driving a gear assembly in the body. A piston has a movable block movably received in the sleeve and a linkage eccentrically connected to the gear assembly. A discharge valve with a nozzle is mounted on the sleeve for discharging compressed air out from the nozzle. Whereby, the sleeve can be made with a small thickness, so its cost is low. Moreover, it is easy to install the sleeve in the correct position to ensure the piston to smoothly reciprocate in the sleeve.

4 Claims, 4 Drawing Sheets

AIR PUMP

BACKGROUND OF THE INVENTION

1. Field of the Invention

The present invention relates to an air pump, and more particularly to an air pump which is easily installed.

2. Description of Related Art

An air pump for inflating tires is generally composed of a body and a motor mounted on the body. The body has a gear assembly and a piston provided therein. The gear assembly has two gears engaged with each other, wherein a first gear is mounted on an output axle of the motor, and a second gear is eccentrically connected to the piston by a linkage. The piston is movably received in a sleeve mounted in an opening at a top of the body. A one-way discharge valve is mounted on the sleeve and in communication with the sleeve.

When the motor is actuated, the gear assembly is rotated to reciprocate the piston in the sleeve, so air flows in the body and is compressed in sleeve and then discharge out from a nozzle of the valve.

However, in assembly, the sleeve is directly installed in the opening in tight fit. Therefore, the sleeve should be formed with a large thickness of inner wall for ensuring good roundness of the sleeve, so the sleeve has a high cost.

Furthermore, because the sleeve is tightly received in the opening, it is difficult to control the sleeve installed in the correct position, so the piston is not coaxial with the sleeve. Thus, air in the chamber may leak out to cause an inadequate air capacity. In the reciprocation of the piston, the friction between the piston and sleeve is large so that a noise of the piston are great. Therefore, it is easy to wear out the sleeve after being used for a short term.

Therefore, the invention provides an air pump to mitigate or obviate the aforementioned problems.

SUMMARY OF THE INVENTION

The main objective of the present invention is to provide an air pump which is easy to install and has a low cost, a small noise in using and a long term of using life.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
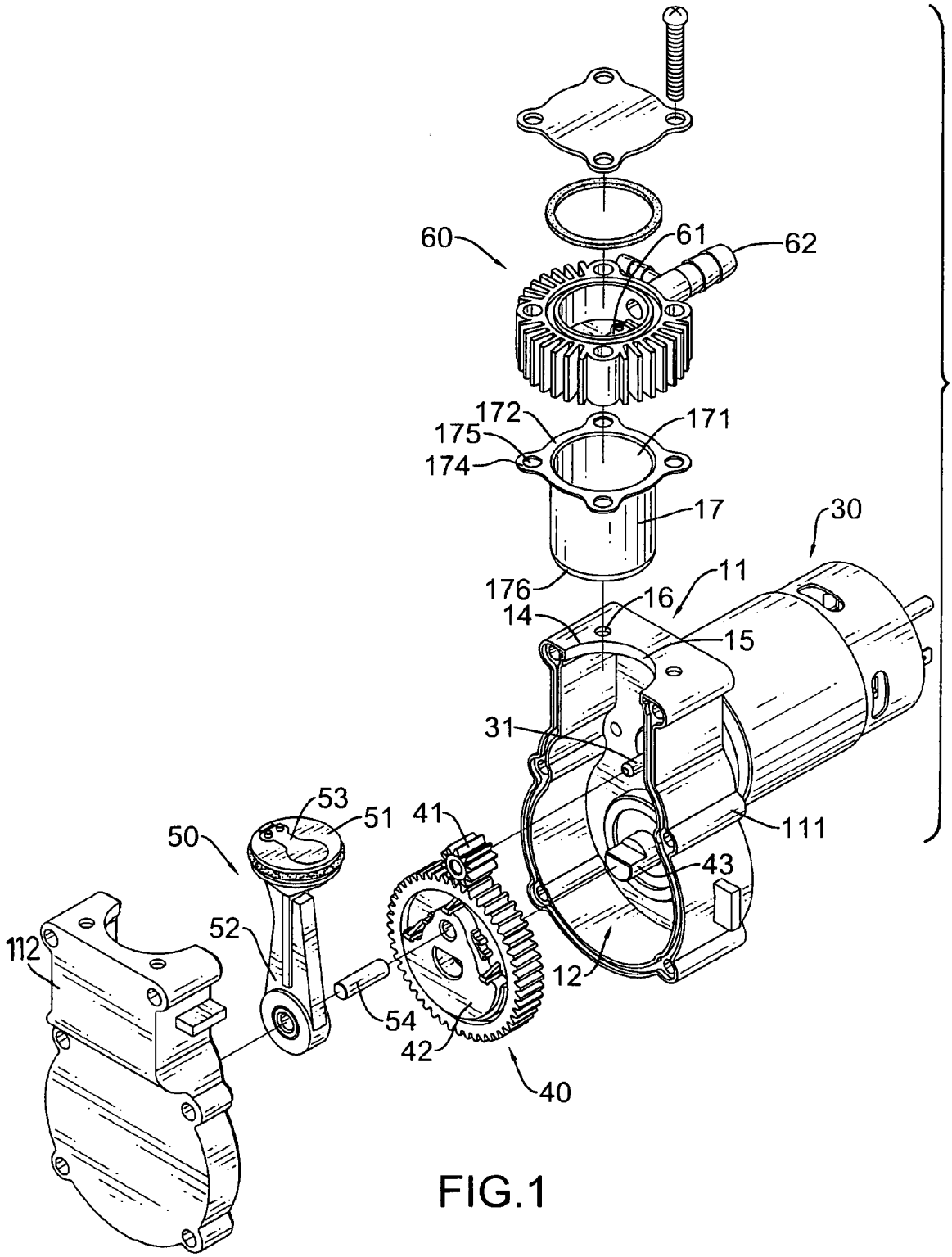
FIG. 1 is an exploded perspective view of an air pump in accordance with the present invention.
Figure 2:
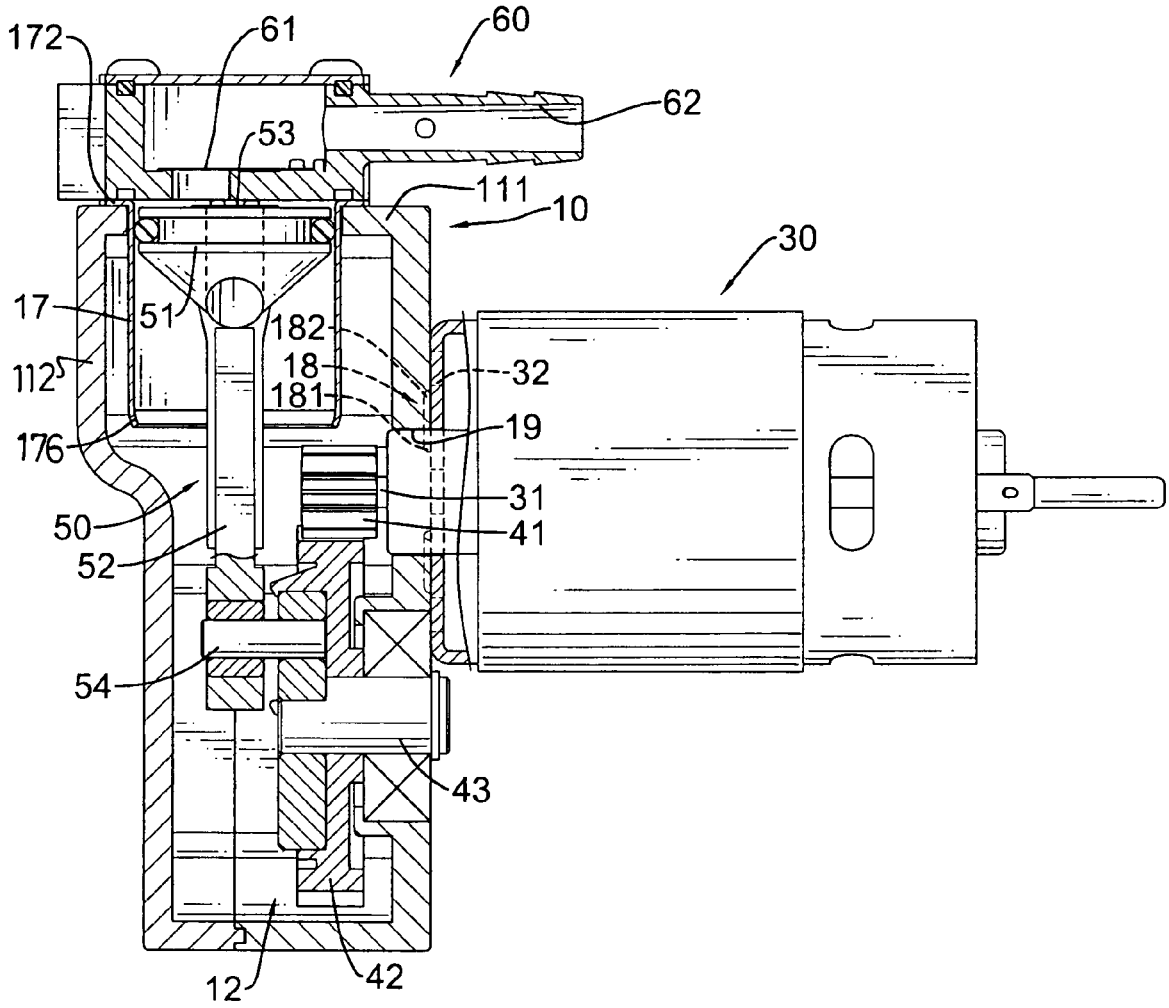
FIG. 2 is a cross sectional view of the air pump of the present invention.
Figure 3:
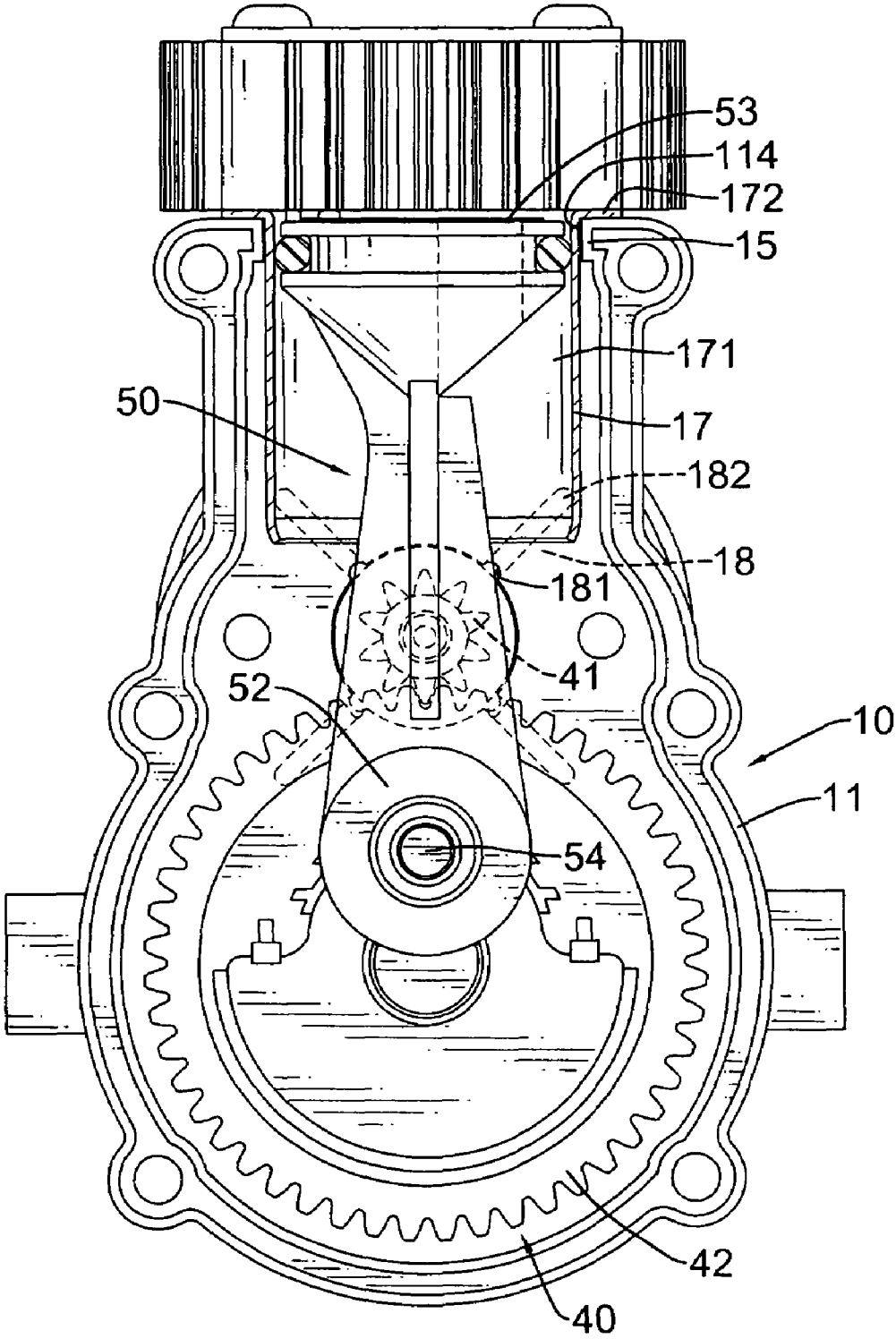
FIG. 3 is a side view of the air pump without an end cover.

With reference to FIGS. 1-3, an air pump in accordance with the present invention has a body (10), a motor (30) mounted on the body (10), a gear assembly (40), a piston (50), and a discharge valve (60).

The body (10) has a housing (11) being composed of a first semi-housing (111) and a second semi-housing (112). A chamber (12) is defined between the two semi-housings (111,112). An axle hole (19) is defined through the first semi-housing (111). The motor (30) is mounted on the first semi-housing (111) and has an output axle (31) extending through the axle hole (19).

Figure 4:
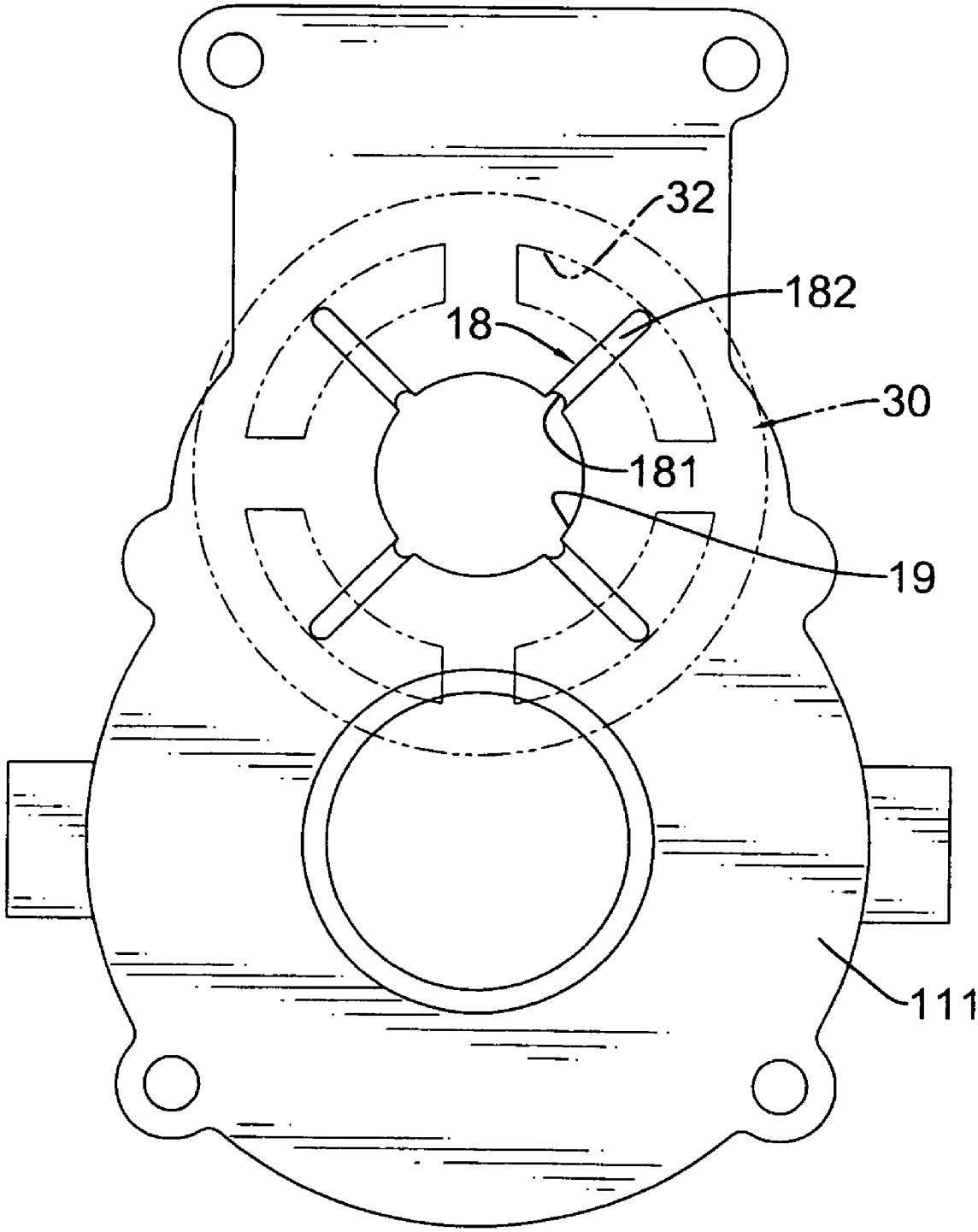
FIG. 4 is a side schematic view of the air pump.

An air inlet (18) is defined at an outer surface of the first semi-housing (111) facing the motor (30) and coaxial with the axle hole (19). With reference to FIGS. 2 and 4, the air inlet (18) has multiple first channels (181) longitudinally defined in the axle hole (19), and multiple second channels (182) defined at the outer surface and respectively radially extending from the first channel (181), and in communication with arcuate slots (32) defined at a front side of the motor (30).

With reference back to FIGS. 1 and 2, an opening (14) is defined at a top of the housing (11) and in communication with the chamber (12). The opening (14) has an inner wall (15) with a certain thickness. Multiple threaded holes (16) are defined around the opening (14) and are formed longitudinally in the top of the housing (11).

A cylindrical sleeve (17) shaped by punching is secured axially in the opening (14) of the housing (11). A passage (171) is defined through the cylindrical sleeve (17). A rim (172) is formed at and protrudes radially from a top edge of the cylindrical sleeve (17) for supporting the sleeve (17) on the top of the housing (11), and multiple ears (174) are formed on the rim (173). Multiple apertures (175) are longitudinally defined respectively through the ears (174) and aligned respectively with the threaded holes (16). By screws inserted respectively through the apertures (175) and engaged in the threaded holes (16), the cylindrical sleeve (17) is secured in the opening (14). An annular recess (176), of which an outer diameter is smaller than that of an outer periphery of the sleeve (17), is defined at a bottom end of the sleeve (17).

The gear assembly (40) is received in the chamber (12) and has a first gear (41) mounted on the output axle (31) of the motor (30). A second gear (42) is rotatably mounted on the first semi-housing (111) by a shaft (43) and meshed with the first gear (41), wherein the first gear (41) has a smaller number of teeth than that of the second gear (42).

The piston (50) has a movable block (51) received in and moves axially in the sleeve (17), and a linkage (52) formed under the movable block (51) and eccentrically connected to the second gear (42) by a pin (54). A first one-way sheet (53) is formed at a top of the movable block (51) to prevent air from flowing back to the chamber (12) from the sleeve (17).

The discharge valve (60) is mounted on the sleeve (17). A second one-way sheet (61) is provided in the discharge valve (60) and aligned with the passage (171) to prevent air from flowing back to the chamber (12) from the discharge valve (60). A nozzle (62) is formed at an outer periphery of the discharge valve (60) and in communication with the passage (17) by the second one-way sheet (61). An upper cover is mounted on the discharge valve (60), and a washer is provided between the upper cover and the discharge valve (60).

With reference to FIGS. 2 and 3, when the motor (30) is actuated to drive the gear assembly (20), the piston (50) is reciprocated upwards and downwards in the passage (171). When the movable block (51) is moved downwards, the second one-way sheet (61) is closed, and external air flows through the arcuate slots (32) and air inlet (18) into the chamber (12). Then, the air in the chamber (12) flows through the first one-way sheet (53) into the passage (171). When the movable block (51) is moved upwards, the air in the passage (171) is compressed. When the compressed air reaches a predetermined pressure, the second one-way sheet (61) is opened to enable the compressed air to flow through the discharge valve (60) and out from the nozzle (62).

According to the present invention, formed with the rim (172) and annular recess (176), the sleeve (17) can be made with a small thickness with a reinforced strength, so its manufacture cost is low. Because the sleeve (17) is secured in the opening (14) by fasteners inserted through the apertures (175), it is easy to install the sleeve (17) in the correct position to ensure the piston (50) to smoothly reciprocate in the sleeve (17). Therefore, the air pump has a small noise in operation and its using life is long.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An air pump comprising:

a body (10) having a housing (11) being composed of a first semi-housing (111) and a second semi-housing (112), a chamber (12) defined between the two semi-housings (111, 112), an opening (14) defined at a top of the housing (11) and in communication with the chamber (12), multiple threaded holes (16) defined around the opening (14) and formed longitudinally in the top of the housing (11), a sleeve (17) with a passage (171) secured axially in the opening (14) and having a rim (172) formed radially on a top end of the sleeve (17) and multiple apertures (175) defined longitudinally through the rim (172) and aligned respectively with the threaded holes (16), an air inlet (18) defined at an outer surface of the first semi-housing (111), and an axle hole (19) defined through the first semi-housing (111) and coaxial with the air inlet (18);

a motor (30) mounted on the first semi-housing (111) of the body (10), the motor (30) having an output axle (31) rotatably extending through the axle hole (19);

a gear assembly (40) received in the chamber (12), the gear assembly (40) having a first gear (41) installed on the output axle (31) of the motor (30), and a second gear (42) rotatably mounted on the first semi-housing (111) and engaged with the first gear (41);

a piston (50) having a movable block (51) received in and moving axially in the passage (171) of the sleeve (17), a linkage (52) formed beneath the movable block (51) and eccentrically connected to the second gear (42) by a pin (54), a first one-way sheet (53) provided in the movable block (51) to prevent air from flowing back into the chamber (12); and a discharge valve (60) mounted on the top of the housing (11), the discharge valve (60) having a nozzle (62) formed on an outer periphery of the discharge valve (60) and in communication with the sleeve (17) by a second one-way sheet (61) provided at a bottom of the valve (60) to prevent air from flowing back into the sleeve (17).

2. The air pump as claimed in claim 1, wherein the sleeve (17) has multiple ears (174) formed on the rim (172), and the apertures (175) are defined respectively through the ears (174).

3. The air pump as claimed in claim 1, wherein the air inlet (18) has multiple first channels (181) longitudinally defined in the axle hole (19), and multiple second channels (182) defined at the outer surface and respectively radially extending from the first channel (181).

4. The air pump as claimed in claim 3, wherein the motor (30) has multiple arcuate slots (32) defined at a side facing the body (10), and the second channels (182) are respectively in communication with the arcuate slots (32).

* * * * *